US007601106B2

(12) United States Patent
Gautier

(10) Patent No.: US 7,601,106 B2
(45) **Date of Patent: *Oct. 13, 2009**

(54) MULTI-AXIS RESISTANCE EXERCISE DEVICE

(76) Inventor: Kenneth Bryan Gautier, 360 Askew Rd., Crenshaw, MS (US) 38621

( * ) Notice: Subject to any disclaimer, the term of this patent is extended or adjusted under 35 U.S.C. 154(b) by 0 days.

This patent is subject to a terminal disclaimer.

(21) Appl. No.: 11/899,463

(22) Filed: Sep. 6, 2007

(65) Prior Publication Data

US 2008/0058175 A1 Mar. 6, 2008

Related U.S. Application Data

(63) Continuation of application No. 10/758,870, filed on Jan. 16, 2004, now Pat. No. 7,341,546.

(60) Provisional application No. 60/441,708, filed on Jan. 21, 2003.

(51) Int. Cl.
*A63B 21/062* (2006.01)

(52) U.S. Cl. ..... 482/103; 482/99

(58) Field of Classification Search ..... 482/93–103, 482/133–138

See application file for complete search history.

(56) References Cited

U.S. PATENT DOCUMENTS

| | | | | |
|---|---|---|---|---|
| 5,018,725 | A * | 5/1991 | Cook | 482/103 |
| 5,102,122 | A * | 4/1992 | Piane et al. | 482/133 |
| 6,165,110 | A * | 12/2000 | Gajda | 482/102 |
| 6,685,600 | B1 * | 2/2004 | Ullman | 482/103 |
| 6,705,976 | B1 * | 3/2004 | Piane, Jr. | 482/103 |
| 7,056,224 | B1 * | 6/2006 | Keyes | 473/257 |
| 7,341,546 | B2 * | 3/2008 | Gautier | 482/103 |
| 2003/0027694 | A1 * | 2/2003 | Harrison | 482/94 |

* cited by examiner

*Primary Examiner*—Fenn C Mathew
(74) *Attorney, Agent, or Firm*—Steven R. Scott

(57) ABSTRACT

A multi-axes exercise machine for strengthening muscles surrounding shoulder joint of a user allows the user a range of motions about lines of motion perpendicular to an arc of circumduction of the shoulder joints. A pair of handholds is suspended from an arcuate guide plate, which extends above a user station. By moving the point of securing the handholds along the length of the arcuate guide plate, the user can re-position the upper ends of the handholds from a location above the user station to a position behind the user station. At all times, the axes of rotation of the handholds are parallel to each other and extend along a plane that contains the axis of circumduction of the user's shoulders. A centerline of each handhold passes through the center of the corresponding glenohumeral joint of the user during the exercise.

24 Claims, 6 Drawing Sheets

MULTI-AXIS RESISTANCE EXERCISE DEVICE

CROSS REFERENCE TO RELATED APPLICATIONS

This continuing application is based on my provisional application No. 60/441,708 filed on Jan. 21, 2003 entitled "Multi-Axis Resistance Exercise Device," and my non-provisional application Ser. No. 10/758,870, with the same title filed Jan. 16, 2004, now U.S. Pat. No. 7,341,546, the full disclosures of which are incorporated by reference herein.

FIELD OF THE INVENTION

This invention is generally related to exercise devices for the upper torso of the human body, and more particularly, to a weight resistance exercise machine for the muscles surrounding the shoulder joints of a user.

BACKGROUND OF THE INVENTION

The shoulder is the most mobile joint in the human body. It has 180 degrees of motion in abduction and forward flexion and 360 degrees of motion in circumduction. The shoulder complex consists of three bones: the upper arm bone (humerus), collarbone (clavicle), and shoulder blade (scapula). These bones are held together by muscles, tendons, and ligaments.

The head of the humerus resembles a ball, which is seated in the glenoid fossa or cavity of the scapula. The structure of the shoulder ball and socket joint allows a wide range of movement of the arm in relation to the upper torso of the human body. The mobility is achieved by having fewer static restraints as compared to similar joints in other parts of a human body. Having fewer restraints means less stability, so the shoulder also has the least static stability of any joint in the human body.

Whereas static stability is provided by bone and non-elastic soft tissues, dynamic stability is provided by elastic and contractile musculotendinous structures. Compensation for reduced static stability in the shoulder is accomplished with enhanced dynamic stability. Unlike static stabilizers, which can provide only endpoint restrains, musculotendinous structures surround the shoulder and provide dynamic restraint throughout the entire range of motion. Without dynamic restraints, the stability of the shoulder has been compared to the instability of a golf ball resting on a golf tee.

Stability for the glenohumeral joint is provided by the muscles which cross the shoulder joint. The rotator cuff is a deep muscle group that holds the humeral head in the glenoid fossa, preventing instability and injurious movements of the humeral head in all directions. The shoulder has a wide range of motion. Circumduction is the arc of circular motion of the shoulder in the saggital plane. The shoulder is also capable of moving through an infinite number of planes of motion, which are perpendicular to the arc of circumduction and which pass through and contain the axis of circumduction.

Flexion identifies a movement whereby the humerus is brought forward beside the thorax. Extension defines a position in which the humerus is returned from any position of flexion to the anatomic position. Abduction defines a motion wherein the humerus moves laterally away from the body. If the person swings his arm sideways, the humerus moves upward as well as laterally to an extended vertical position beside the head. Adduction defines the motion in which the humerus is returned to the side of the body from 180 degrees of abduction. Rotation defines the motion of the shoulder wherein the humerus turns medially or laterally on its long axis.

Muscles surrounding the shoulder can be exercised to protect the shoulder joint and increase the strength in the upper torso area. To enhance strength through all planes of motion, one must strengthen the moving muscles in all planes of motion. The strengthening exercise requires resistance in any plane of motion of the joint through a full 360-degree arc. It is well known that by moving resistance in different planes of motion of a muscle, different planes of fibers are employed to move the resistance, stimulating maximum strength gains within the same specific plane of fibers and motion exercised. Conventional exercise machines provide resistance for shoulder motion in only a few planes of motion. But because strength, stability, and performance of the shoulder are specifically enhanced only in the planes of motion trained, comprehensive strength training of the shoulder requires resistance exercise in many different planes of motion.

The present invention contemplates elimination of drawbacks associated with prior art exercise machines and provision of a multi-axis exercise machine for the upper torso that provides resistance exercise in an exponential number of planes.

SUMMARY OF THE INVENTION

It is therefore an object of the present invention to provide an exercise machine for the upper torso and more specifically for the muscles surrounding the shoulder joint.

It is another object of the present invention to provide an exercise machine that allows the shoulder to move in a variety of planes and about a variety of axes to increase stability and strength of the shoulder joint.

These and other objects of the invention are achieved through a provision of an apparatus for exercising the upper torso of a user, which allows the user to move the anus and shoulder joints through multiple planes and about multiple axes of rotation. The exercise machine has an upright positionable on a stable supporting surface and a support body that carries handholds for engagement by the user's arms and hands. The handholds are at the end of arms detachably repositionable on a guide plate, which extends above the handholds, and to which the upper ends of the arms are securely attached. Resistance to the movement of the handholds is provided by a weight stack positioned in the upright and connected by a flexible link to a spool, which in turn is connected to a gear assembly.

The gear assembly is operationally connected to a distant pivot assembly and through an extendable arm, to a proximal pivot assembly. The upper ends of the arms are connected to the proximal pivot assembly, providing force transmission to the arms. During movement of the arms, the axes of rotation of the arms are always oriented parallel to each other and perpendicular to the arc of circumduction of the shoulder joints of the user, in the preferred embodiment. The rotational arcs of exercise are perpendicular to the plane of circumduction of the corresponding shoulder of the user in the preferred embodiment.

BRIEF DESCRIPTION OF THE DRAWINGS

Reference will now be made to the drawings wherein like parts are designed by like numerals, and wherein.

DETAILED DESCRIPTION OF THE PREFERRED EMBODIMENT

Figure 1:
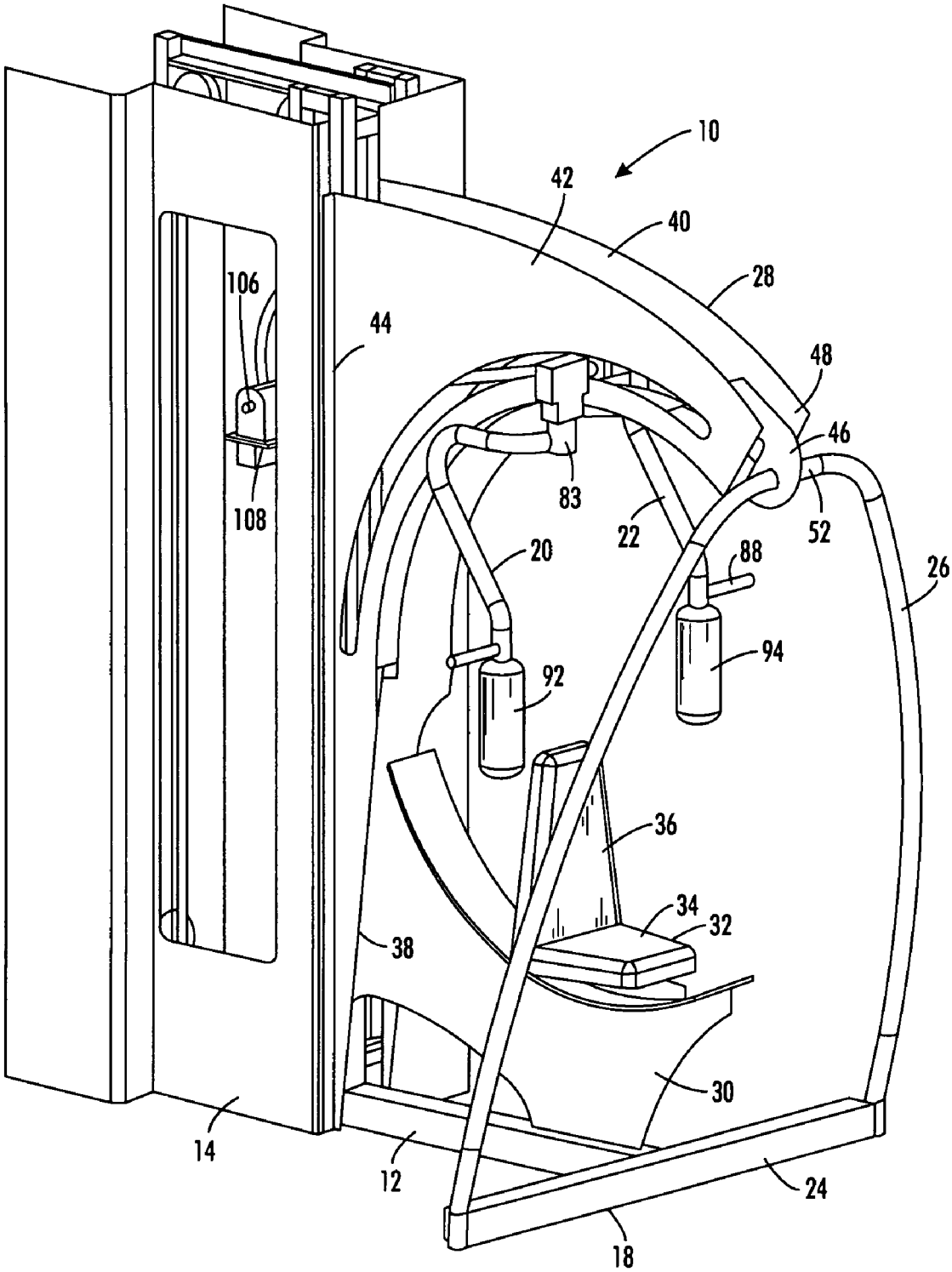
FIG. 1 is a perspective view of the multi-axis exercise machine in accordance with the present invention.

Turning now to the drawings in more detail, numeral 10 designates the exercise machine in accordance with the present invention. The apparatus 10 comprises a support assembly including a base member 12 adapted to rest on a supporting surface, such as the floor of an exercise room. A vertical upright 14 is secured to the base member and extends upwardly therefrom to receive and enclose a portion of a weight resistance means, which includes a weight stack 16. The weight stack 16 is operationally connected through a flexible link to other parts of the weight resistance means through a gearbox and pivot assemblies, to a pair of arms 20, 22.

An optional stabilizing member 18 is securely attached transversely to the base member 12. The stabilizing member 18 comprises a cross bar 24 and an upwardly extending arc-shaped member 26, which is connected to a support body 28. The vertical upright 14 and the support body 28 form an enclosure for the majority of the moving parts of the exercise machine of the present invention, such as the lifting gear box, pivoting gearboxes, and the telescoping shaft, as will be described in more detail hereinafter.

Mounted on the base 12 is a user station 32, which comprises a chair support member 30, which is adapted to support a user chair 32 thereon. The chair 32 has a horizontal seat 34 and a vertical back 36 adapted to support a person in a sitting position facing towards or away from back 36 for use of the apparatus of the present invention. The chair support member 30 is fixedly attached to the vertical upright 14 along a vertical side 38 thereof.

The support body 28 is comprised of a pair of parallel members 40, 42, each of which is attached along a respective vertical side 44 (for member 42) to the vertical upright 14. The support body 28 extends above the chair 32. An attachment plate 46 secured between the distal ends 48, 50 of the support members 40, 42, respectively. The attachment plate 46 engages the top portion of the stabilizing arc 26. The attachment plate 46 is provided with an opening through which a central top part 52 of the stabilizing arc 26 is inserted. In this manner, the stabilizing forces of the stabilizing member 18 are added to the stabilizing forces provided by the upright 14 and the base 12.

Turning now to the working or active portions of the exercise machine 10, with particular reference to FIGS. 2-6, the exercise machine 10 comprises an arcuate plate, guide plate, or guide 60 which is generally an arcuate structural member or plate extending above the user station 30 and having a front end 64 oriented along a plane generally forward of the user station and a back end 66 oriented along a plane behind the user station 30. A detachably re-positionable carrier or carrying plate 61 is mounted on top of the guide plate 60. The carrying plate 61 has substantially the same radius of curvature as the guide plate 60. The carrying plate 61 can be secured at a plurality of locations along the length of the guide plate 60 depending on user's preference on the angle of rotation of the rigid interface members (or arms) 20, 22 in relation to a horizontal surface.

A pair of upwardly extending plates 68, 70 is detachably secured to the carrying plate 61. Pivotally secured between the plates 68 and 70 is a proximal pivot assembly 72. The proximal pivot assembly 72 is mounted for pivotal movement in relation to the plates 68 and 70. A distant pivot assembly 74 is connected to the proximate pivot assembly 72 by an extendable telescoping arm, or shaft 76.

An upper end of the arm 22 is secured in a cylindrical member 81, which in turn is attached to an attachment block 82; an upper end 84 of the arm 20 is similarly secured, through a cylindrical member 83 to an attachment block 86. The arms 20, 22 are secured to the attachment blocks 82, 86 such that their axes of rotation 200, 201 are always parallel to each other and perpendicular to an arc of circumduction of the shoulder joints of a user seated in the user station 30. The arm 22 is provided with a user interface such as a handhold or handgrip 88; the arm 20 is likewise provided with a handgrip 90. The handgrips 88 and 90 are rigid bars affixed to respective lower ends of the arms 20 and 22. The wins 20 and 22 can be optionally provided with another form of user interface such as cushioned arm engaging members 92 and 94, respectively.

The distant pivot assembly 74 is operationally connected to a lifting gearbox 100 through a connecting shaft 102. The distant pivot assembly 74 pivots about a pivot pin 104 extending through the unit 74 and engaged with an upright plate 106. A supporting plate 108 supports the lifting gearbox 100 and the upright plate 106. A plurality of pulleys 110 is mounted behind the lifting gear box 100. A flexible link, such as for instance belt 112 extends between the pulleys 110 and the weight stack 16. The flexible link 112 wounds about a spool 118, a rotating shaft of which (not shown) is operationally connected to the shaft of the gear assembly 100. Tensioning of the belt 112 causes the weight stack 16 to be lifted, to some degree, and move the shaft 114 supporting the weight stack 16 within a weight stack sleeve 116.

Figure 2:
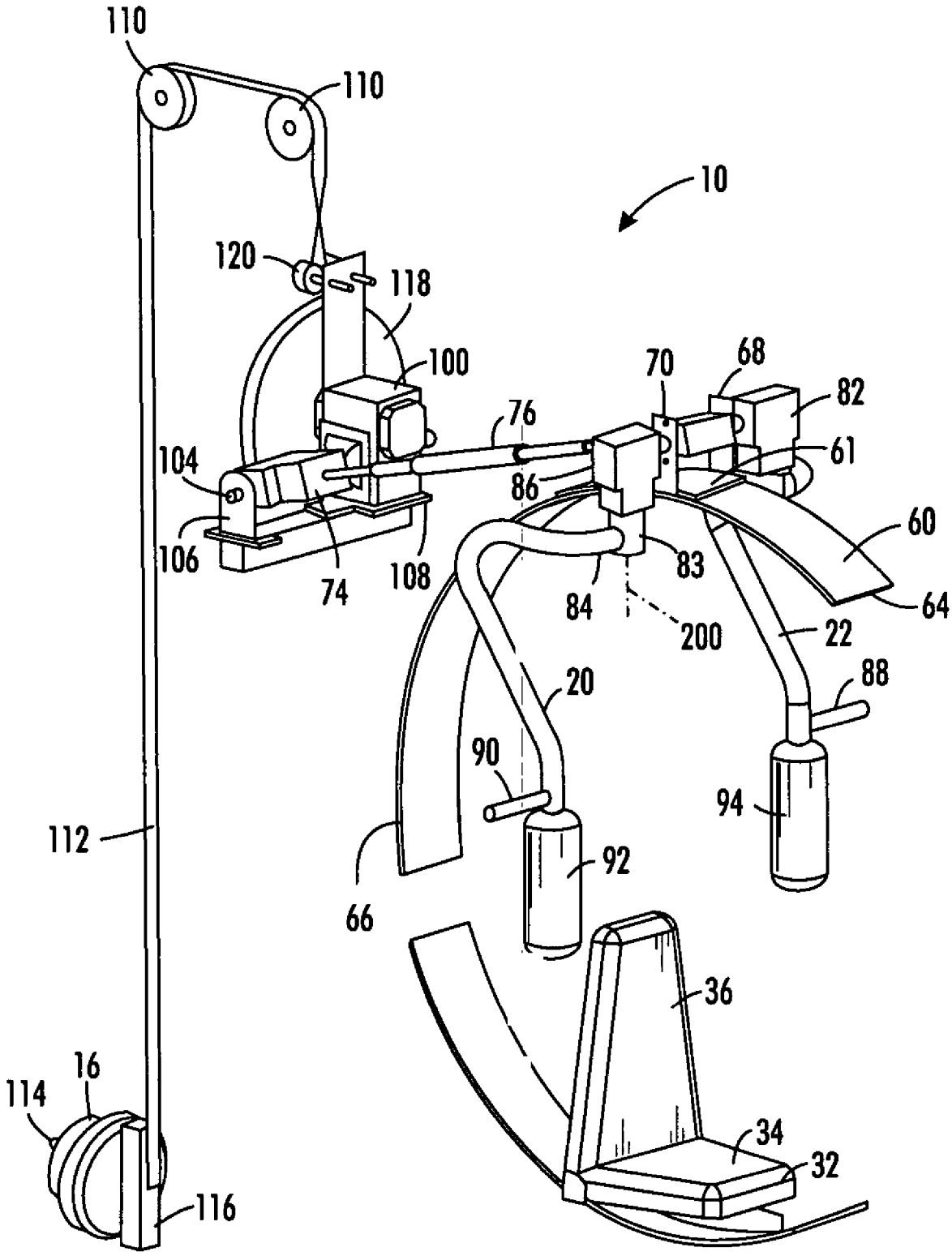
FIG. 2 is a perspective view of the active portions of the exercise machine of the present invention.
Figure 3:
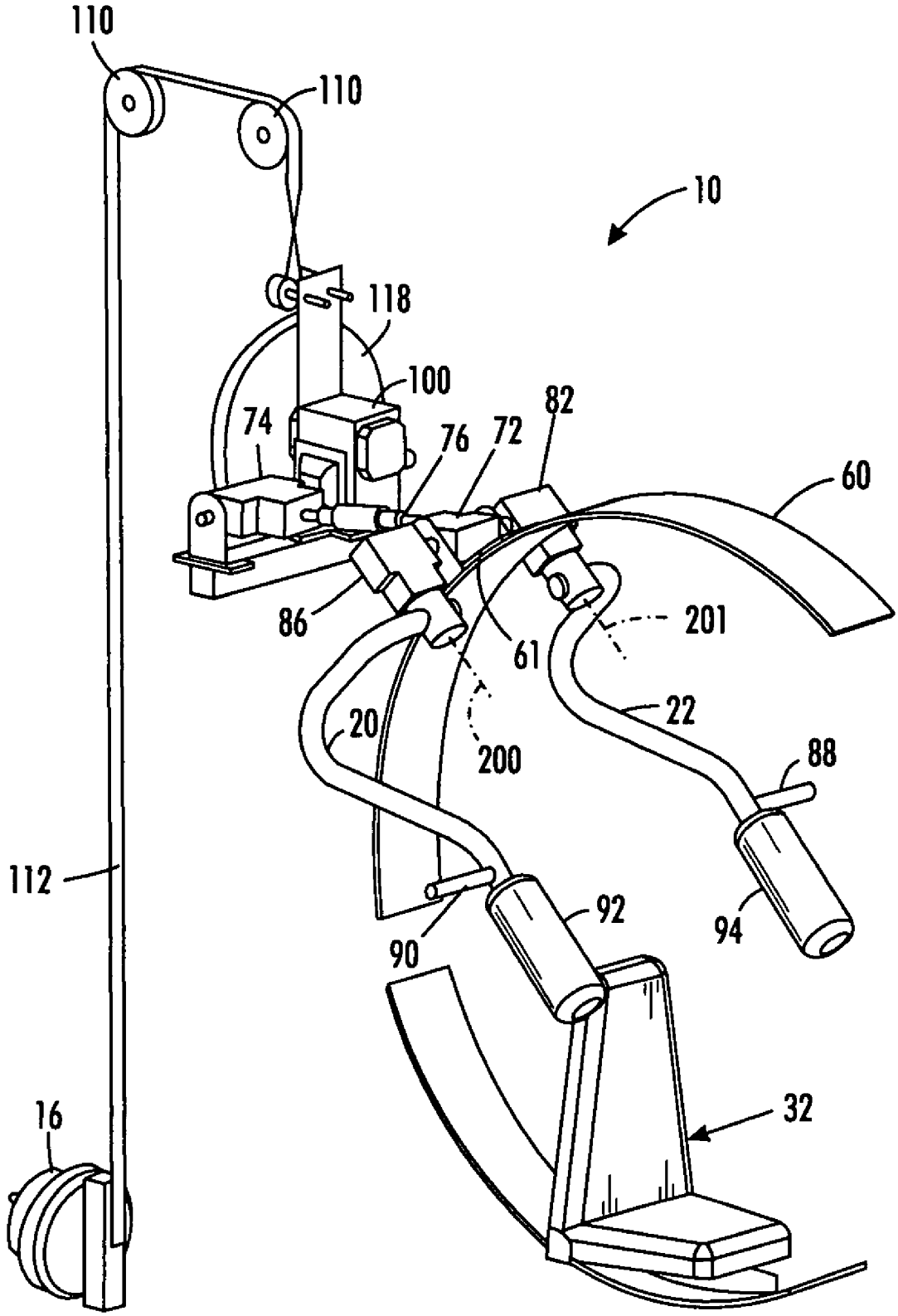
FIG. 3 is a perspective view of the active portion of the exercise machine of the present invention with the arms extended forward of the backseat of the user chair.
Figure 4:
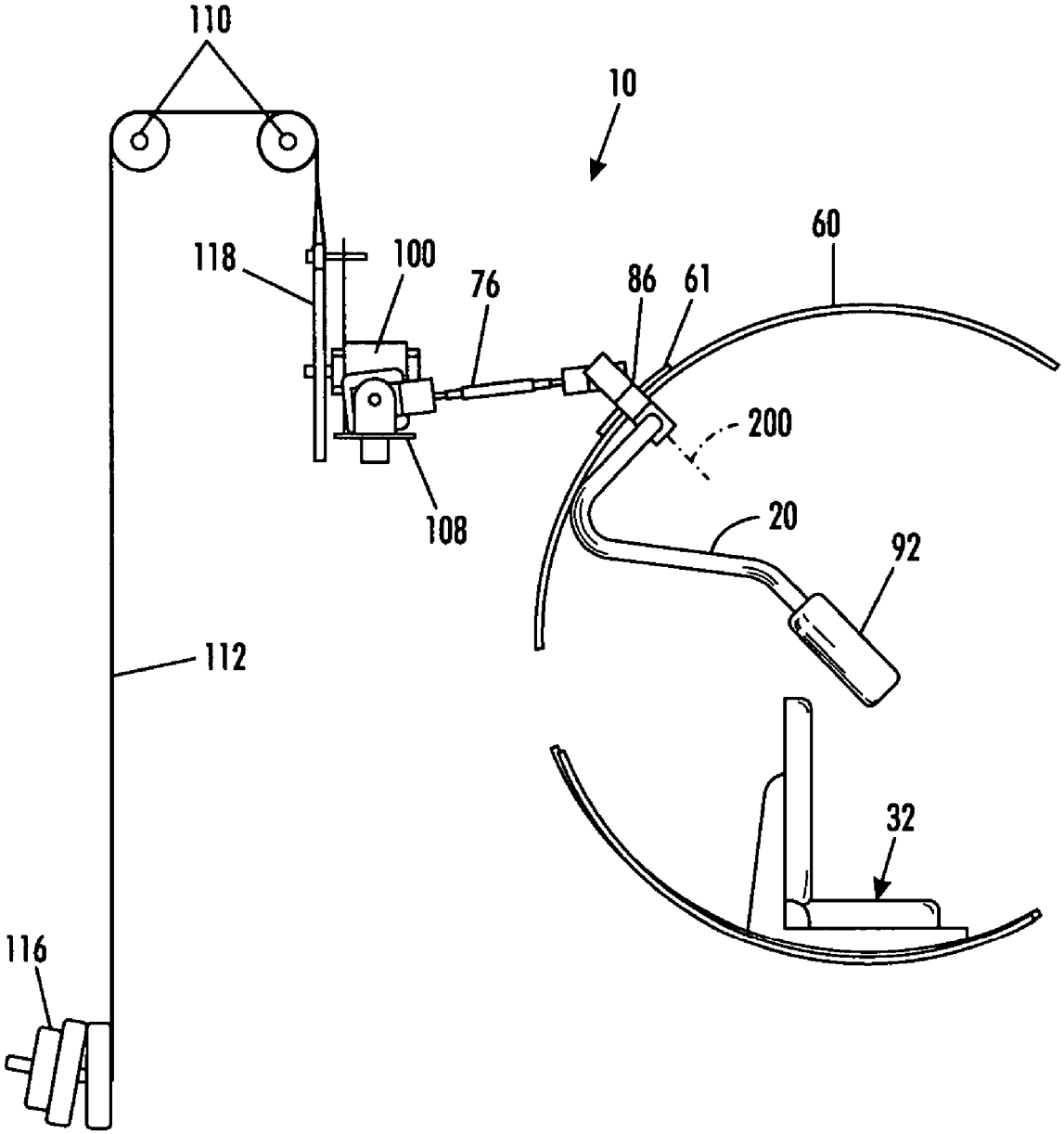
FIG. 4 is a side view of the active portion of the exercise machine of the present invention with the arms in a position similar to the position in FIG. 3.

In operation, the user is seated on the seat 34 with his legs on opposite sides of the chair seat 34. The user grasps the handgrips 88 and 90 such that the user's arms contact the cushioned arm supports 92 and 94. With the handle attachment blocks 82 and 86 in an uppermost position on the guide 60, such as shown in FIG. 2, the user applies force on the arms 20 and 22 to push them together or apart. The telescopic shaft 76 is extended fully in this position. The pivotal motion of the arms 20, 22 is resisted by the weight stack 16, causing the muscle fibers to grow and elongate. The rotational axis 200, 201 of the arms 20, 22 is always perpendicular to the arc of circumduction of the user's shoulders joint, allowing a multi-axis movement of the shoulder joints.

To continue exercising the muscles at different angles and axes, the user repositions the carrying plate 61 with attachment blocks 82 and 86, to the back and down along the guide plate 60. The user secures the attachment blocks 82 and 86 in the newly selected position noting that the telescoping shaft 76 has been shortened. In the new position, the axes of rotation 200, 201 of the arms 20, 22 are oriented at a different angle in relation to a horizontal plane. The user repeats the extension and squeezing motion on the arm 20 and 22, again acting against the resistance of the weight stack 16.

Figure 5:
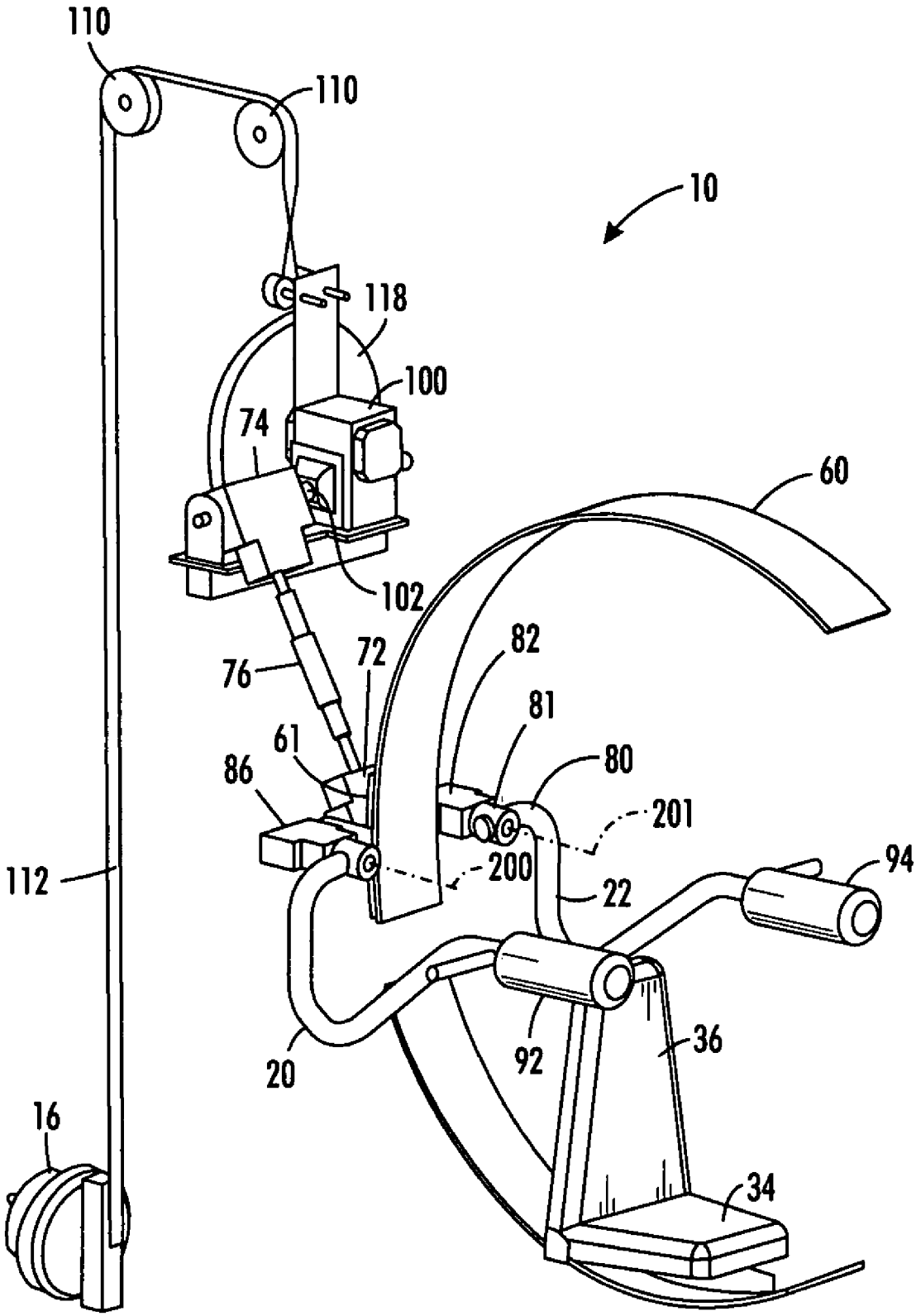
FIG. 5 is a perspective view of the active portion of the exercise machine of the present invention with the arms' upper ends moved behind the user station.
Figure 6:
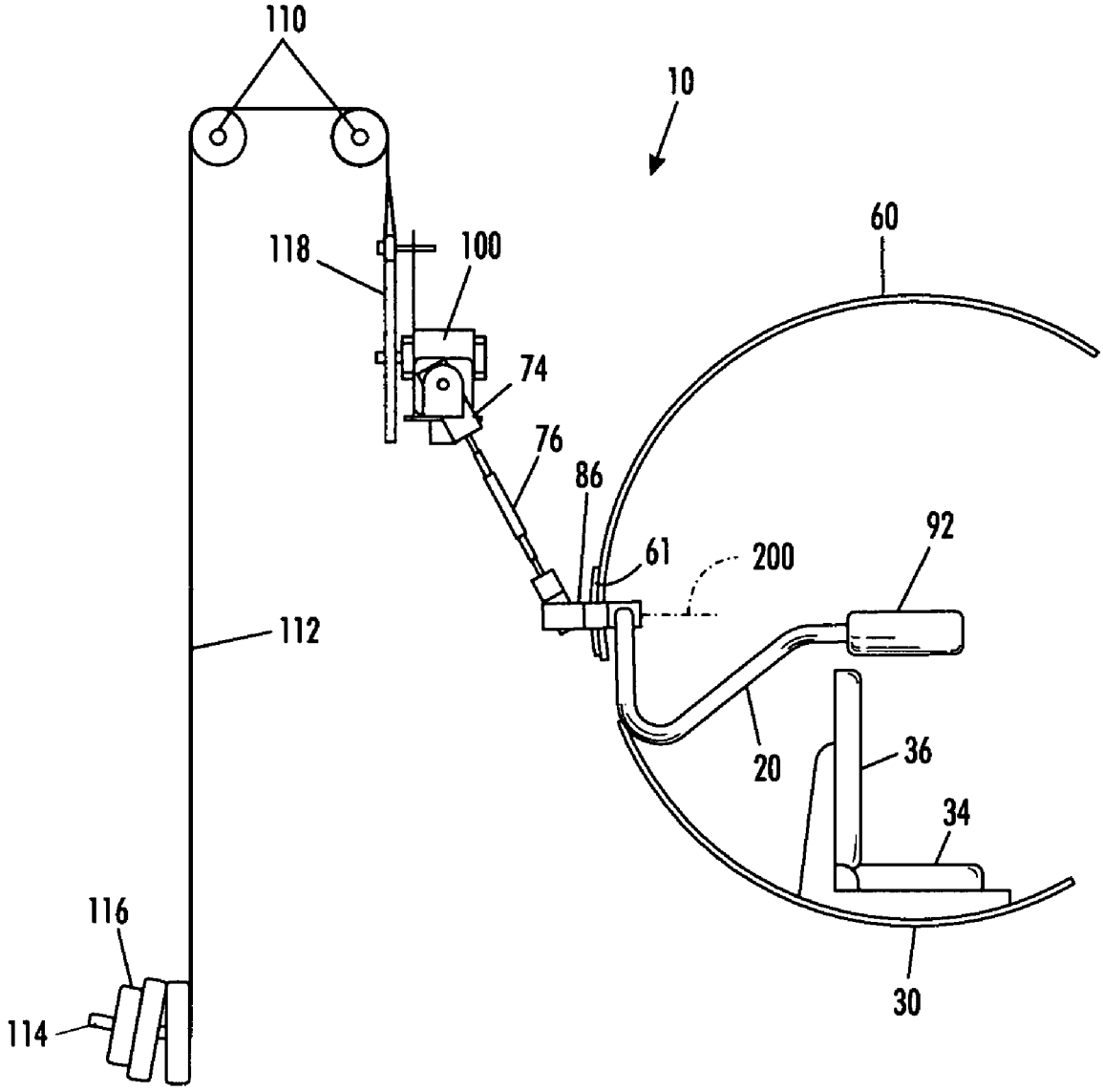
FIG. 6 is a side view of the active portion exercise machine of the present invention showing the position of the arms similar to the position in FIG. 5.

The lowermost position of the attachment blocks 82 and 86, as shown in FIGS. 5 and 6, places the handgrips 88 and 90 in an almost horizontal position. The attachment blocks 82 and 86 are secured adjacent the rearmost portion 66 of the guide plate 60 allowing the arms of the user to move in a plane, which is substantially different from a plane of movement when the attachment blocks 82 and 86 are positioned closer to the front end 64 of the guide plate 60.

The exercise machine of the present invention allows a multi-plane resistance exercise, training, rehabilitation, as well as strength testing of the shoulder joints of the user. Both anterior and exterior muscles of the human body surrounding the shoulder joints are forced to move through multiple stages of extension and abduction. The lifting gearbox can provide a number of resistance selections, such as step up, step down, 1:1 gear ratios.

The spool 118 mounted co-axially on the shaft of the gear assembly 100 transmits resistance to the gear assembly output shaft. The spool 118 converts the mass of the suspended weight stack 16 to resistance moment vector. The resistance force is then transferred to the resistance mechanism gear output shaft and from there—to a second shaft, which is the gear input shaft. The gear/weight stack assembly provides the necessary mass and resistance force to movement of the arms 20 and 22 allowing to strengthen the muscles surrounding the shoulder joint of the user.

Due to the uniform force created by the weight stack 16 on both handholds 20, 22, the movements of the arms 20 and 22 facilitate symmetrical exercise of both arms and muscle groups surrounding the shoulder joints. The rotational axes 200, 201 of movement of the arms 20, 22 are always parallel to each other, with the plane of the exercise always perpendicular to the arc of circumduction of the shoulders of the user. The rotational axis 200, 201 of each arm 20, 22 passes through the center of the corresponding glenohumeral joint, intercepting and perpendicular to the axis of circumduction of the shoulders.

The axes rotation 200, 201 of the handholds define the rotational axis of exercise for the corresponding shoulder of the user. When the user moves the arms 20 and 22, revolving about the rotational axis of the exercise, and the handles move in an arc, this allows complete extension, abduction and rotation of each shoulder of the user. The opposite moments of force produced by the left and right handholds are uniformly transmitted to the telescoping shaft 76 and then to the distant pivot assembly and the lifting gearbox, in effect connecting the output of the proximal pivot assembly to the gear box input shaft in series. The user-created moment vector is opposite in direction to and maintained in a co-linear relationship with the resistance moment vector transmitted through the telescoping shaft. The telescoping shaft 76 has the capability of telescoping within itself or through gearing within the resistance gear assembly.

The chair seat 34 can be vertically adjusted to facilitate positioning of the shoulders and therefore the height of the axis of shoulder circumduction of the user at the most beneficial level. If desired, the guide plate 60 can be also adjustably secured on the upright 14 to lower or raise the arc and thereby accommodate the user in the best possible manner. The apparatus 10 provides a pre-determined resistance to muscle fibers of the shoulder during the exercise, as well as tangential resistance (isotonic resistance) or dynamic variable resistance through the full range of the arc motion of the exercise. If desired, the weight stack 16 may be substituted by any other desired form of resistance, for instance, magnetic mechanism and the like. The user may exercise or train both shoulders simultaneously or one shoulder if desired.

Many changes and modifications can be made with the design of the present invention without departing from the spirit thereof. I therefore pray that my rights to the present invention be limited only by the scope of the appended claims.

I claim:

1. An apparatus for exercising an upper torso, comprising:

a support assembly;

an arcuate guide mounted in an upper portion of the support assembly;

a pair of rigid arms transversely extending from said arcuate guide, said arms having axes of rotation spaced at a selected distance from each other, each rigid arm comprising an upper end pivotally mounted and re-positionable with respect to the guide and a lower end with handhold; and apparatus for adjusting resistance to movement of said arms when the distance between the handholds is one of: increased by a user and decreased by a user.

2. The apparatus of claim 1, further comprising a user station located below the arms, and wherein said guide extends from a location forward of the user station to a location behind the user station.

3. The apparatus of claim 2, wherein axes of rotation of the arms at least one of substantially co-axially disposed with corresponding glenohumeral joints of the user positioned in the user station, and substantially perpendicular to axes of circumduction of the glenohumeral joints of the user.

4. The apparatus of claim 1, wherein the axes of rotation of the arms are substantially perpendicular to an arc of circumduction of shoulder joints of the user.

5. The apparatus of claim 1, wherein the axes of rotation of the arms are parallel to each other and are located in a plane, which plane contains axes of circumduction of shoulder joints of the user.

6. The apparatus of claim 1, wherein said guide comprises an arcuate plate bearing a carrier for securing upper ends of the arms to the guide.

7. The apparatus of claim 1, wherein said apparatus for adjusting resistance comprises a weight stack mounted in said support assembly and a gear assembly operationally connected to the weight stack and to the handles.

8. The apparatus of claim 7, wherein said apparatus for adjusting resistance further comprises a distant pivot assembly operationally connected to the gear assembly, a proximal pivot assembly mounted on the arcuate guide and operationally connected to the distant pivot assembly and to the arms, said distant pivot assembly and said proximal pivot assembly being connected by an elongated extendable shaft.

9. The apparatus of claim 7, wherein said apparatus for adjusting resistance further comprises a flexible connecting member extending between the weight stack and the gear assembly.

10. An apparatus for exercising one or more shoulder joints of a user, comprising:

support assembly;

an arcuate guide mounted in said support assembly;

a pair of rigid arms transversely extending from said arcuate guide, each rigid arm comprising an upper end pivotally mounted and re-positionable at a plurality of locations along the length of the guide and a lower end with handhold; and apparatus for adjusting resistance to movement of said arms by a user.

11. The apparatus set forth in claim 1, wherein the apparatus is arranged so that the arcuate guide is centered on a point lying on an axis intersecting a shoulder joint of a user.

12. The apparatus of claim 10, wherein the arms are substantially perpendicular to an arc of circumduction of the shoulder joints of the user when the user moves the arms irrespective of a relative position of the upper ends of the arms along the length of the guide.

13. The apparatus of claim 10, wherein the axes of rotation of the arms are located in a plane, which plane contains axes of circumduction of shoulder joints of the user irrespective of a relative position of the upper ends of the arms along the length of the guide.

14. The apparatus of claim 10, further comprising a user station located below the arms, and wherein said guide has an apex of the arc, which apex is oriented substantially above the user station.

15. The apparatus of claim 13, wherein axes of rotation of the arms are at least one of substantially co-axially disposed with corresponding shoulder joints of the user, and substantially perpendicular to axes of circumduction of the shoulder joints of the user.

16. The apparatus of claim 14, wherein the arcuate guide extends from a location forward of the user station to a location behind the user station.

17. The apparatus of claim 10, wherein said apparatus for adjusting resistance comprises a weight stack mounted in said support assembly and a gear assembly operationally connected to the weight stack and to the arms.

18. The apparatus of claim 17, wherein said apparatus for adjusting resistance further comprises a distant pivot assembly operationally connected to the gear assembly, a proximal pivot assembly mounted on the arcuate plate and operationally connected to the distant pivot assembly and to the arms, said proximal pivot assembly and said distant pivot assembly being connected by an elongated extendable shaft.

19. The apparatus of claim 17, wherein said apparatus for adjusting resistance further comprises a flexible connecting member extending between the weight stack and the gear assembly.

20. The apparatus set forth in claim 10, wherein the apparatus is arranged so that the arcuate guide is centered on a point lying on an axis intersecting a shoulder joint of a user.

21. An apparatus for exercising muscles associated with a ball joint of the human body, comprising:

an arcuate guide, said arcuate guide being centered on a point lying on an axis intersecting said ball joint;

a rigid interface member transversely extending from said arcuate guide, which arms has a first end pivotally connected and positionable at a plurality of points along said arcuate guide, and a second end with a user interface; and apparatus for adjusting resistance to movement of said user interface by a user.

22. The apparatus set forth in claim 21, wherein the apparatus is arranged to exercise muscles of a shoulder joint of a user such that the axis is an axis passing through a shoulder joint of the user.

23. The apparatus of claim 22, wherein the axis is a circumduction axis of the shoulder joint of the user.

24. The apparatus of claim 21, wherein the arcuate guide lies in and thereby defines a plane, and movement of said user interface defines an arc of motion transverse to said plane.

* * * * *